US011495189B1

(12) United States Patent
Chien

(10) Patent No.: US 11,495,189 B1
(45) Date of Patent: Nov. 8, 2022

(54) SOURCE DRIVER AND OUTPUT BUFFER THEREOF OF LIQUID CRYSTAL DISPLAY

(71) Applicant: HIMAX TECHNOLOGIES LIMITED, Tainan (TW)

(72) Inventor: Chia-Chu Chien, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 17/659,665

(22) Filed: Apr. 19, 2022

(51) Int. Cl.
*G09G 3/36* (2006.01)

(52) U.S. Cl.
CPC ..... *G09G 3/3688* (2013.01); *G09G 3/3614* (2013.01); *G09G 2310/0291* (2013.01); *G09G 2320/0252* (2013.01)

(58) Field of Classification Search
CPC ... G09G 2310/0297; G09G 2310/0291; G09G 2310/08; G09G 2310/0286; G09G 3/36; G09G 3/3614; G09G 3/3275; G09G 3/3266; G09G 2320/0209; G09G 2320/0233; G09G 2320/0247; G09G 2300/0842
See application file for complete search history.

(56) References Cited

U.S. PATENT DOCUMENTS

2002/0149608 A1* 10/2002 Bu ..... G09G 3/3688 345/690
2009/0015574 A1* 1/2009 Kim ..... G09G 3/3688 345/94
2010/0123690 A1* 5/2010 Jeon ..... G09G 3/3688 345/204
2017/0032755 A1* 2/2017 Ko ..... G09G 3/3688
2018/0190192 A1* 7/2018 Kwon ..... G09G 3/3233

OTHER PUBLICATIONS

Ravi Teja, "Multiplexer (MUX) and Multiplexing", Apr. 12, 2021, https://www.electronicshub.org/multiplexerandmultiplexing/ (Year: 2021).*
Ravi Teja, "What is a Demultiplexer (Demux)?", Apr. 14, 2021, https://www.electronicshub.org/demultiplexerdemux/ (Year: 2021).*

* cited by examiner

*Primary Examiner* — Dong Hui Liang
(74) *Attorney, Agent, or Firm* — CKC & Partners Co., LLC

(57) ABSTRACT

An output buffer is provided, which including an input circuit, output circuits, a first multiplexer, a second multiplexer and a demultiplexer. The input circuit is for generating a first control signal and a second control signal according to a feedback signal and an input signal. Each output circuit is controlled by a first gate signal and a second gate signal to provide a corresponding one of output signals. The first multiplexer is for providing the first control signal and the second control signal to one of the output circuits as the first gate signal and the second gate signal, respectively. The second multiplexer is for providing a first reference voltage and a second reference voltage as the first gate signal and the second gate signal, respectively, to other of the output circuits. The demultiplexer is for providing one of the output signals as the feedback signal.

20 Claims, 10 Drawing Sheets

SOURCE DRIVER AND OUTPUT BUFFER THEREOF OF LIQUID CRYSTAL DISPLAY

BACKGROUND

Technical Field

The present disclosure relates to liquid crystal display technology. More particularly, the present disclosure relates to a source driver and an output buffer thereof.

Description of Related Art

The liquid crystal display (LCD) is applied to various commercial electronic products due to the advantages of mature manufacture process and energy saving. A long-term direct current (DC) potential may cause ion impurities in the liquid crystal to from a residual field that causes image retention. To solve this problem, four polarity schemes typically used to drive the LCD, which are frame inversion, dot inversion, row inversion and column inversion. A source driver is used to drive data lines of a display. As the resolution and/or the frame rate of the display increases, output buffers are implemented into the source driver to improve charging speed to the data lines. Generally, the source driver also includes multiplexers located between the output buffers and the data lines to swap the polarities or to set the data lines in a high-impedance (Hi-Z) state. However, the multiplexers increase output loading of the output buffers, thereby reducing slew rate of the output buffers.

SUMMARY

The disclosure provides a source driver configured to receive display data and including a plurality of output buffers. Each output buffer includes an input circuit, a plurality of output circuits, a first multiplexer, a second multiplexer and a demultiplexer. The input circuit is configured to generate a first control signal and a second control signal according to a feedback signal and an input signal corresponding to the display data. Each output circuit is controlled by a first gate signal and a second gate signal to provide a corresponding one of a plurality of output signals. The first multiplexer is configured to provide the first control signal and the second control signal to one of the plurality of output circuits as the first gate signal and the second gate signal, respectively. The second multiplexer is configured to provide a first reference voltage and a second reference voltage as the first gate signal and the second gate signal, respectively, to other of the plurality of output circuits. The demultiplexer is configured to provide one of the plurality of output signals as the feedback signal.

The disclosure provides an output buffer including an input circuit, a plurality of output circuits, a first multiplexer, a second multiplexer and a demultiplexer. The input circuit is configured to generate a first control signal and a second control signal according to a feedback signal and an input signal. Each output circuit is controlled by a first gate signal and a second gate signal to provide a corresponding one of a plurality of output signals. The first multiplexer is configured to provide the first control signal and the second control signal to one of the plurality of output circuits as the first gate signal and the second gate signal, respectively. The second multiplexer is configured to provide a first reference voltage and a second reference voltage as the first gate signal and the second gate signal, respectively, to other of the plurality of output circuits. The demultiplexer is configured to provide one of the plurality of output signals as the feedback signal.

It is to be understood that both the foregoing general description and the following detailed description are by examples, and are intended to provide further explanation of the disclosure as claimed.

DETAILED DESCRIPTION

Figure 1:
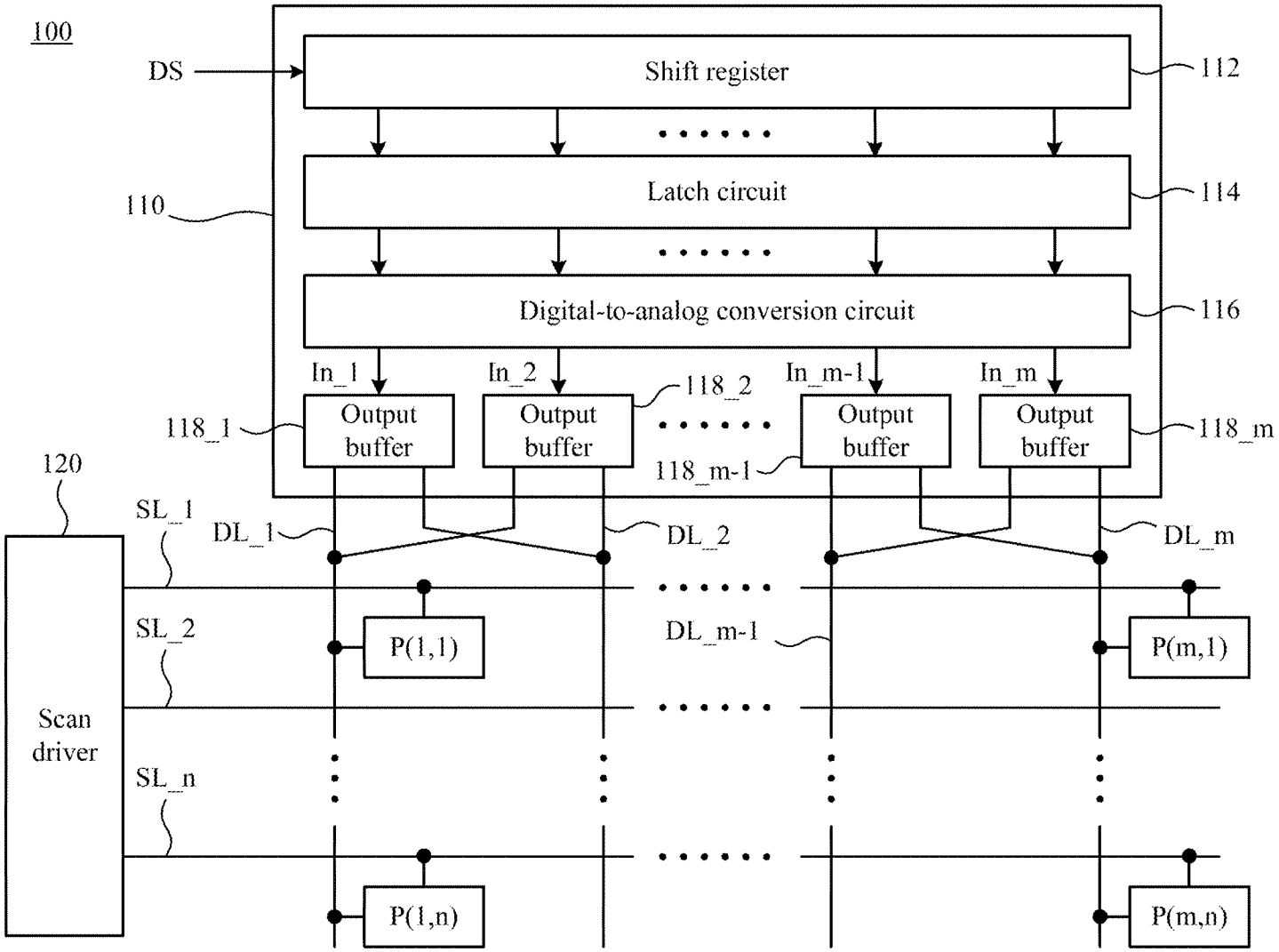
FIG. 1 is a simplified functional block diagram of a display device according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a simplified functional block diagram of a display device 100 according to an embodiment of the present disclosure. The display device 100 includes a source driver 110, a scan driver 120, a plurality of data lines DL_1-DL_m, a plurality of scan lines SL_1-SL_n and a plurality of pixels P(1,1)-P(m,n). The pixels P(1,1)-P(m,n) are arranged in correspondence to intersections of the data lines DL_1-DL m and the scan lines SL 1-SL n. The source driver 110 is configured to receive and convert display data DS into voltages transmitted through the data lines DL_1-DL_m. Cooperating with the scan driver 120, these voltages can be used to update an image displayed by the pixels P(1,1)-P(m,n).

In an embodiment, the pixels P(1,1)-P(m,n) may be realized by liquid crystal pixel circuits. The display device 100 may further include a back light module (not shown in the figure) assisting in the control of contrast and brightness.

In an embodiment, the source driver 110 includes a shift register 112, a latch circuit 114, a digital-to-analog conversion circuit 116 and a plurality of output buffers 118_1-**118_*m*. The shift register 112, the latch circuit 114 and the digital-to-analog conversion circuit 116 are configured to convert the display data DS into a plurality of input signals In_1-In_m. The output buffers 118_1-118_*m*** are configured to amplify the input signals In_1-In_m, respectively, to provide positive-polarity output signals and negative-polarity output signals to the data lines DL_1-DL_m.

In an embodiment, for example, each output buffer having an odd index in the reference label (e.g., the output buffers 118_1, 118_3, etc.) is configured to provide the positive-polarity output signal (hereinafter referred to as "positive-polarity output buffer"). Each output buffer having an even index in the reference label (e.g., the output buffers 118_2, 118_4, etc.) is configured to provide the negative-polarity output signal (hereinafter referred to as "negative-polarity output buffer"). Each of the output buffers 118_1-**118_*m*** is coupled with two of the data lines DL_1-DL_m. Adjacent output buffers may share a pair of data lines, and are configured to alternately drive said pair of data lines.

For example, the output buffers 118_1-118_2 are coupled to the data lines DL_1-DL_2. In a first time period, the output buffer 118_1 outputs the positive-polarity output signal to the data line DL_1, and the output buffer 118_2 outputs the negative-polarity output signal to the data line DL_2. In a second time period successive to the first time period, the output buffer 118_1 outputs the positive-polarity output signal to the data line DL_2, and the output buffer 118_2 outputs the negative-polarity output signal to the data line DL_1. However, this disclosure is not limited thereto.

Figure 2:
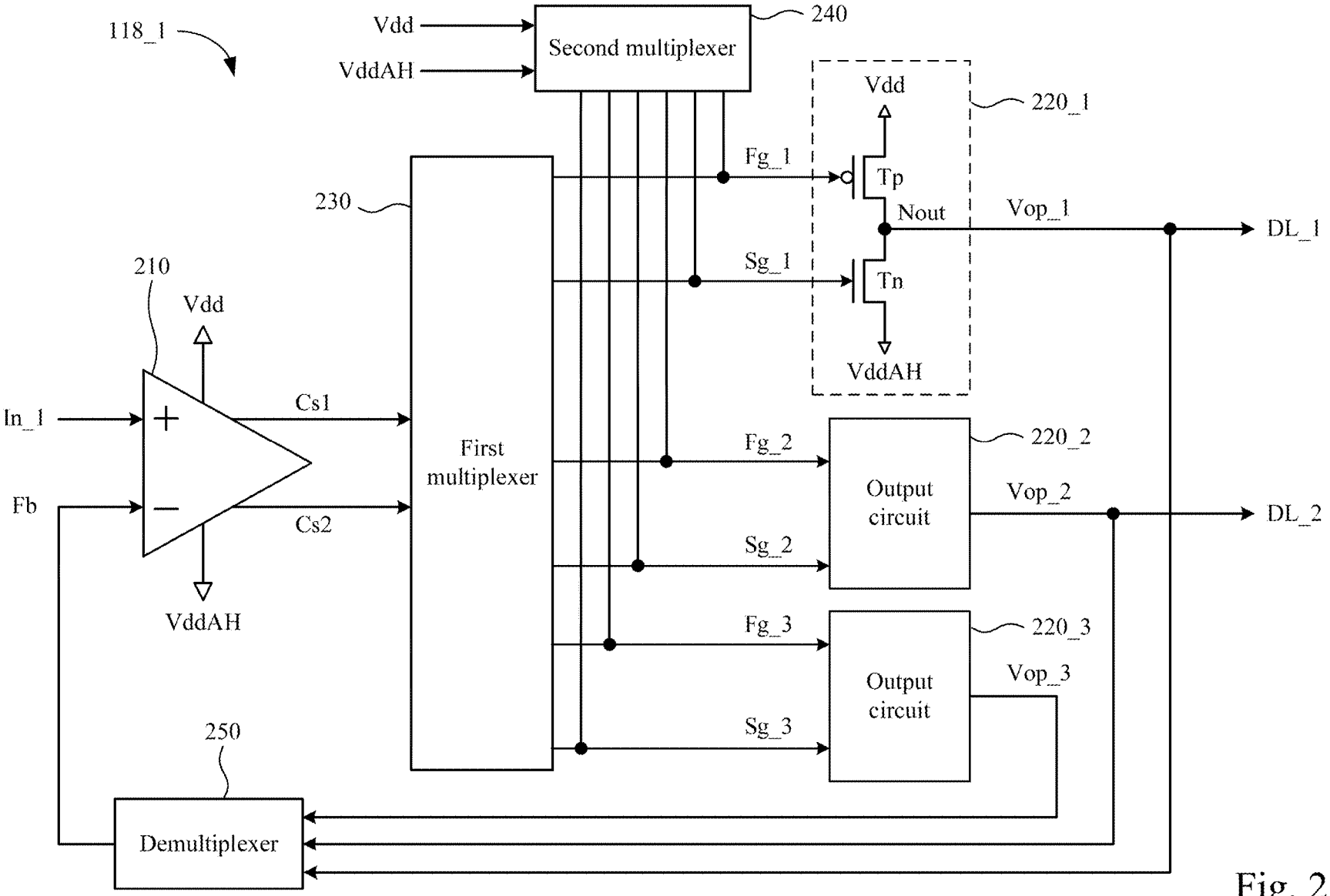
FIG. 2 is a schematic diagram of a positive-polarity output buffer according to an embodiment of the present disclosure.

FIG. 2 is a schematic diagram of the output buffer 118_1 according to an embodiment of the present disclosure. The output buffer 118_1 of FIG. 2 includes an input circuit 210, a plurality of output circuits 220_1-220_3, a first multiplexer 230, a second multiplexer 240 and a demultiplexer 250. The input circuit 210 is configured to generate a first control signal Cs1 and a second control signal Cs2 according to the input signal In_1 and a feedback signal Fb. In an embodiment, the input circuit 210 receives a reference voltage Vdd and a reference voltage VddAH as operating voltages used to amplify the input signal In_1, so as to generate the first control signal Cs1 and the second control signal Cs2. That is, the reference voltage Vdd and the reference voltage VddAH may be the maximum voltage and the minimum voltage received by the input circuit 210, respectively, but this disclosure is not limited thereto.

The output circuits 220_1-220_3 are controlled by a plurality of first gate signals Fg_1-Fg_3 and a plurality of second gate signals Sg_1-Sg_3, so as to generate a plurality of output signals Vop_1-Vop_3, respectively. The output circuit 220_1 comprises a pull-up transistor Tp and a pull-down transistor Tn. A gate terminal of the pull-up transistor Tp and a gate terminal of the pull-down transistor Tn are configured to receive the first gate signal Fg_1 and the second gate signal Sg_1, respectively. The pull-up transistor Tp and the pull-down transistor Tn are coupled in series, in which an output node Nout between the pull-up transistor Tp and the pull-down transistor Tn is configured to provide the output signal Vop_1. The output circuits 220_2-220_3 have components and structures similar to those of the output circuit 220_1 discussed above, and thus those descriptions are omitted.

In this embodiment, the output singles Vop_1-Vop_2 are provided to the data lines DL_1-DL_2, respectively. The output signal Vop_3, however, is free from being transmitted to the data lines DL_1-DL_m.

The first multiplexer 230 is configured to distribute both the first control signal Cs1 and the second control signal Cs2 to one of the output circuits 220_1-220_3. The first multiplexer 230 outputs the first control signal Cs1 as a first gate signal of the first gate signals Fg_1-Fg_3, and outputs the second control signal Cs2 as a second gate signal of the second gate signals Sg_1-Sg_3. Said first gate signal (e.g., the first gate signal Fg_1) and said second gate signal (e.g., the second gate signal Sg_1) are transmitted to the same output circuit (e.g., the output circuit 220_1).

The second multiplexer 240 is configured to transmit the reference voltage Vdd to output circuits (e.g., the output circuits 220_2-220_3) which do not receive the first control signal Cs1. As a substitute for the first control signal Cs1, the reference voltage Vdd is taken as the first gate signals (e.g., the first gate signals Fg_2-Fg_3). The second multiplexer 240 is also configured to transmit the reference voltage VddAH to the output circuits (e.g., the output circuits 220_2-220_3) which do not receive the second control signal Cs2, so that the reference voltage VddAH is taken as the second gate signals (e.g., the second gate signals Sg_2-Sg_3).

The demultiplexer 250 is configured to receive the output signals Vop_1-Vop_3, and configured to selectively provide one of the output signals Vop_1-Vop_3 as the feedback signal Fb.

Figure 3:
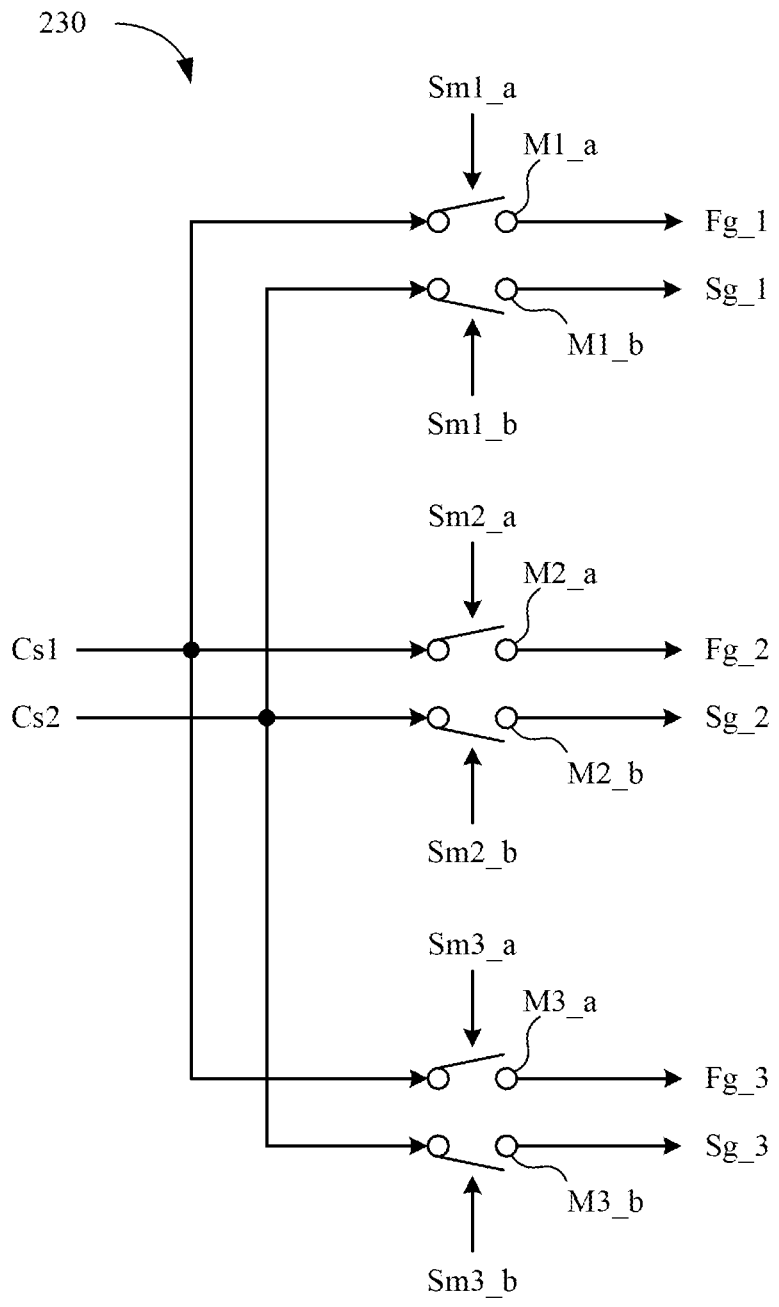
FIG. 3 is a schematic diagram of a first multiplexer according to an embodiment of the present disclosure.

Reference is made to FIG. 2 and FIG. 3, in which FIG. 3 is a schematic diagram of the first multiplexer 230 according to an embodiment of the present disclosure. The first multiplexer 230 includes a pair of first multiplexing switches M1_*a*-M1_*b*, a pair of second multiplexing switches M2_*a*-M2_*b* and a pair of third multiplexing switches M3_*a*-M3_*b*.

A first terminal of the first multiplexing switch M1_*a* is coupled with a first output terminal of the input circuit 210 to receive the first control signal Cs1. A second terminal of the first multiplexing switch M1_*a* is coupled with the gate terminal of the pull-up transistor Tp of the output circuit 220_1, so as to provide the first control signal Cs1 as the first gate signal Fg_1. A first terminal of the first multiplexing switch M1_*b* is coupled with a second output terminal of the input circuit 210 to receive the second control signal Cs2. A second terminal of the first multiplexing switch M1_*b* is coupled with the gate terminal of the pull-down transistor Tn of the output circuit 220_1, so as to provide the second control signal Cs2 as the second gate signal Sg_1. The first multiplexing switches M1_*a*-M1_*b* are controlled by a pair of first multiplexing signals Sm1_*a*-Sm1_*b*, respectively. The first multiplexing signals Sm1_*a*-Sm1_*b* operate the first multiplexing switches M1_*a*-M1_*b* synchronously, that is, the first multiplexing switches M1_*a*-M1_*b* are conducted or switched-off synchronously.

Similarly, the second multiplexing switches M2_*a*-M2_*b* are coupled with the input circuit 210 to receive the first control signal Cs1 and the second control signal Cs2, respectively. A pair of second multiplexing signals Sm2_*a*-Sm2_*b* synchronously operates the second multiplexing switches M2_*a*-M2_*b* to provide the first gate signal Fg_2 and the second gate signal Sg_2 to the gate terminal of the pull-up transistor Tp and the gate terminal of the pull-down transistor Tn of the output circuit 220_2, respectively. The third multiplexing switches M3_*a*-M3_*b* are coupled with the input circuit 210 to receive the first control signal Cs1 and the second control signal Cs2, respectively. A pair of third multiplexing signals Sm3_*a*-Sm3_*b* synchronously operates the third multiplexing switches M3_*a*-M3_*b* to provide the first gate signal Fg_3 and the second gate signal Sg_3 to the gate terminal of the pull-up transistor Tp and the gate terminal of the pull-down transistor Tn of the output circuit 220_3, respectively.

Figure 4:
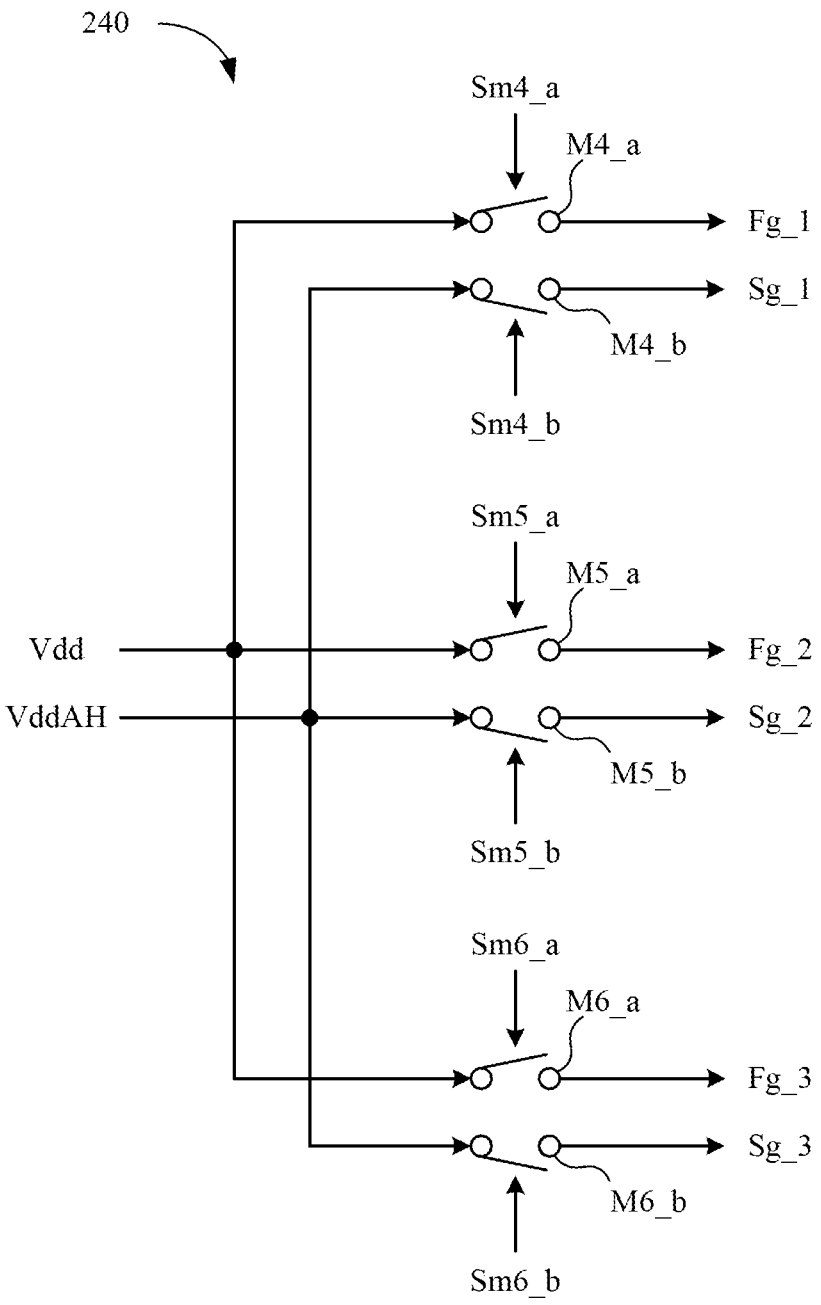
FIG. 4 is a schematic diagram of a second multiplexer according to an embodiment of the present disclosure.

Reference is made to FIG. 2 and FIG. 4, in which FIG. 4 is a schematic diagram of the second multiplexer 240 according to an embodiment of the present disclosure. The second multiplexer 240 includes a pair of fourth multiplexing switches M4_*a*-M4_*b*, a pair of fifth multiplexing switches M5_*a*-M5_*b* and a pair of sixth multiplexing switches M6_*a*-M6_*b*.

A first terminal of the fourth multiplexing switch M4_*a* is configured to receive the reference voltage Vdd. A second terminal of the fourth multiplexing switch M4_*a* is coupled with the gate terminal of the pull-up transistor Tp of the output circuit 220_1, so as to provide the reference voltage Vdd as the first gate signal Fg_1. A first terminal of the fourth multiplexing switch M4_*b* is configured to receive the reference voltage VddAH. A second terminal of the fourth multiplexing switch M4_*b* is coupled with the gate terminal of the pull-down transistor Tn of the output circuit 220_1, so as to provide the reference voltage VddAH as the second gate signal Sg_1. The fourth multiplexing switches M4_*a*-M4_*b* are controlled by a pair of fourth multiplexing signals Sm4_*a*-Sm4_*b*, respectively. The fourth multiplexing signals Sm4_*a*-Sm4_*b* operate the fourth multiplexing switches M4_*a*-M4_*b* synchronously, that is, the fourth multiplexing switches M4_*a*-M4_*b* are conducted or switched-off synchronously.

In an embodiment, the reference voltage Vdd is configured to switch off the pull-up transistor Tp, and the reference voltage VddAH is configured to switch off the pull-down transistor Tn.

Similarly, the fifth multiplexing switches M5_*a*-M5_*b* are configured to receive the reference voltage Vdd and the reference voltage VddAH, respectively. A pair of fifth multiplexing signals Sm5_*a*-Sm5_*b* synchronously operates the fifth multiplexing switches M5_*a*-M5_*b* to provide the first gate signal Fg_2 and the second gate signal Sg_2 to the gate terminal of the pull-up transistor Tp and the gate terminal of the pull-down transistor Tn of the output circuit 220_2, respectively. The sixth multiplexing switches M6_*a*-M6_*b* are configured to receive the reference voltage Vdd and the reference voltage VddAH, respectively. A pair of sixth multiplexing signals Sm6_*a*-Sm6_*b* synchronously operates the sixth multiplexing switches M6_*a*-M6_*b* to provide the first gate signal Fg_3 and the second gate signal Sg_3 to the gate terminal of the pull-up transistor Tp and the gate terminal of the pull-down transistor Tn of the output circuit 220_3, respectively.

Figure 5:
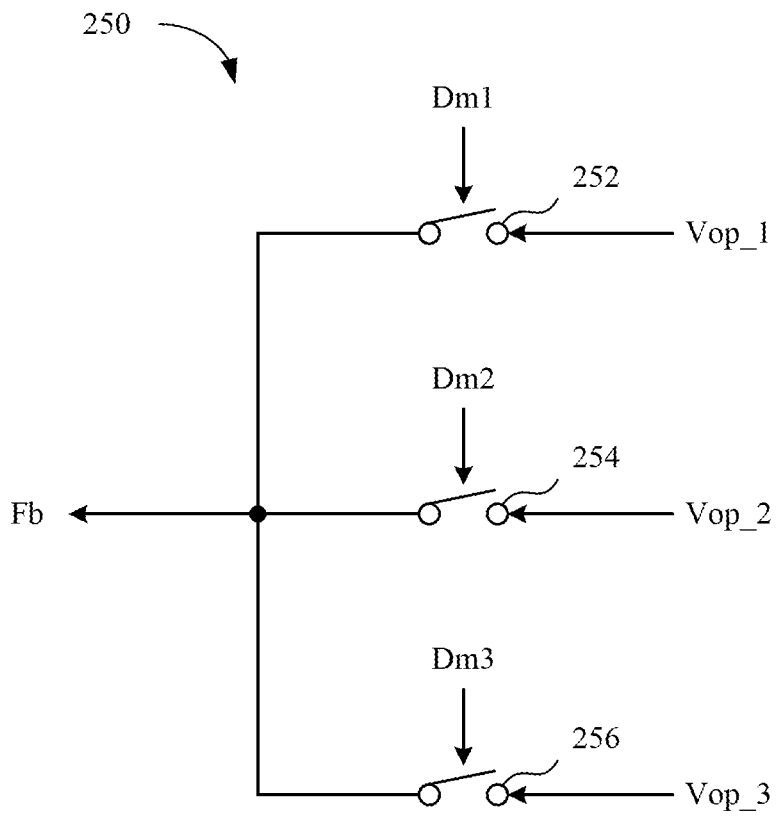
FIG. 5 is a schematic diagram of a demultiplexer according to an embodiment of the present disclosure.

Reference is made to FIG. 2 and FIG. 5, in which FIG. 5 is a schematic diagram of the demultiplexer 250 according to an embodiment of the present disclosure. The demultiplexer 250 includes a first demultiplexing switch 252, a second demultiplexing switch 254 and a third demultiplexing switch 256. A first terminal of the first demultiplexing switch 252, a first terminal of the second demultiplexing switch 254 and a first terminal of the third demultiplexing switch 256 are coupled with one of the input terminals (e.g., the inverting input terminal) of the input circuit 210 to provide the feedback signal Fb to the input circuit 210. A second terminal of the first demultiplexing switch 252 is coupled with the output node Nout of the output circuit 220_1, so as to receive the output signal Vop_1.

Similarly, a second terminal of the second demultiplexing switch 254 is coupled with the output circuit 220_2 to receive the output signal Vop_2, and a second terminal of the third demultiplexing switch 256 is coupled with the output circuit 220_3 to receive the output signal Vop_3. The first demultiplexing switch 252, the second demultiplexing switch 254 and the third demultiplexing switch 256 are controlled by a first demultiplexing signal Dm1, a second demultiplexing signal Dm2 and a third demultiplexing signal Dm3, respectively. In operation, when one of the first demultiplexing switch 252, the second demultiplexing switch 254 and the third demultiplexing switch 256 is conducted, the other demultiplexing switches are switched off.

Reference is made to FIGS. 2-6, FIG. 6 is a waveform schematic of the output buffer 118_1 of FIG. 2 according to an embodiment of the present disclosure. The operation of the output buffer 118_1 may include a high-impedance (Hi-Z) stage St_hi, a first output stage St_1 and a second output stage St_2. The output buffer 118_1 may alternately conduct the first output stage St_1 and the second output stage St_2. The high-impedance stage St_hi is inserted between the first output stage St_1 and the second output stage St_2. In the following paragraphs, a disabled level represents a voltage level that switches off the switch, and an enabled level represents a voltage level that conducts the switch. Although the disabled level and the enabled level are depicted as a low level and a high level, respectively, in FIG. 6 and FIG. 9 to be discussed, one of ordinary skilled in the art would appreciate that actual voltage levels of the disabled level and the enabled level may vary with types of semiconductors used to realize the switch. For example, the disabled level and the enabled level of an N-type transistor switch are a low voltage level and a high voltage level, respectively. As another example, the disabled level and the enabled level of a P-type transistor switch is the high voltage level and the low voltage level, respectively.

With respect to the high-impedance stage St_hi, the first multiplexing signals Sm1_*a*-Sm1_*b* and the second multiplexing signals Sm2_*a*-Sm2_*b* have the disabled level, and the third multiplexing signals Sm3_*a*-Sm3_*b* have the enabled level. The first multiplexing switches M1_*a*-M1_*b* and the second multiplexing switches M2_*a*-M2_*b* are switched-off, and the third multiplexing switches M3_*a*-M3_*b* are conducted. The first multiplexer 230 outputs the first control signal Cs1 and the second control signal Cs2 as the first gate signal Fg_3 and the second gate signal Sg_3, respectively, to the output circuit 220_3. In addition, the fourth multiplexing signals Sm4_*a*-Sm4_*b* and the fifth multiplexing signals Sm5_*a*-Sm5_*b* have the enabled level, and the sixth multiplexing signals Sm6_*a*-Sm6_*b* have the disabled level. The fourth multiplexing switches M4_*a*-M4_*b* and the fifth multiplexing switches M5_*a*-M5_*b* are conducted, and the sixth multiplexing switches M6_*a*-M6_*b* are switched-off. The second multiplexer 240 outputs the reference voltage Vdd and the reference voltage VddAH as the first gate signals Fg_1-Fg_2 and the second gate signals Sg_1-Sg_2, respectively, to the output circuits 220_1-220_2.

Therefore, the output circuits 220_1-220_2 are disabled. The data lines DL_1-DL_2 are floating and free from receiving signals from the output buffer 118_1. In addition, the output circuit 220_3 of the output buffer 118_1 is enabled and provides the output signal Vop_3 to the demultiplexer 250. The first demultiplexing signal Dm1 and the second demultiplexing signal Dm2 have the disabled level to switch off the first demultiplexing switch 252 and the second demultiplexing switch 254. The third demultiplexing signal Dm3 has the enabled level to conduct the third demultiplexing switch 256 so as to output the output signal Vop_3 as the feedback signal Fb.

In an embodiment, outputting the output signal Vop_3 as the feedback signal Fb can stabilize voltages of internal nodes of the input circuit 210 during the high-impedance period St_hi, so as to prevent malfunctions of the input circuit 210 that may be caused by lack of a negative feedback loop. Stabilizing the internal node voltages of the input circuit 210 also helps to improve a reaction speed of the input circuit 210 when entering the first output stage St_1 or the second output stage St_2, so as to ensure a timely response of the first control signal Cs1 and the second control signal Cs2 to the input signal In_1 in the first output stage St_1 and the second output stage St_2.

With respect to the first output stage St_1, the first multiplexing signals Sm1_*a*-Sm1_*b* have the enabled level, and the second multiplexing signals Sm2_*a*-Sm2_*b* the third multiplexing signals Sm3_*a*-Sm3_*b* have the disabled level. The first multiplexing switches M1_*a*-M1_*b* are conducted, and the second multiplexing switches M2_*a*-M2_*b* and the third multiplexing switches M3_*a*-M3_*b* are switched-off. The first multiplexer 230 outputs the first control signal Cs1 and the second control signal Cs2 as the first gate signal Fg_1 and the second gate signal Sg_1, respectively, to the output circuit 220_1. In addition, the fourth multiplexing signals Sm4_*a*-Sm4_*b* have the disabled level, and the fifth multiplexing signals Sm5_*a*-Sm5_*b* and the sixth multiplexing signals Sm6_*a*-Sm6_*b* have the enabled level. The fourth multiplexing switches M4_*a*-M4_*b* are switched off, and the fifth multiplexing switches M5_*a*-M5_*b* and the sixth multiplexing switches M6_*a*-M6_*b* are conducted. The second multiplexer 240 outputs the reference voltage Vdd and the reference voltage VddAH as the first gate signals Fg_2-Fg_3 and the second gate signals Sg_2-Sg_3, respectively, to the output circuits 220_2-220_3.

Therefore, the output circuit 220_1 is enabled to provide the positive-polarity output signal Vop_1 to the data line DL_1, and the output circuits 220_2-220_3 are disabled (the data line DL_2 may receive a negative-polarity output signal Von_1 from the output buffer 118_2, which will be discussed in the following by reference to FIG. 7). The first demultiplexing signal Dm1 has the enabled level to conduct the first demultiplexing switch 252, so as to output the output signal Vop_1 as the feedback signal Fb. The second demultiplexing signal Dm2 and the third demultiplexing signal Dm3 have the disabled level to switch off the second demultiplexing switch 254 and the third demultiplexing switch 256.

With respect to the second output stage St_2, the second multiplexing signals Sm2_*a*-Sm2_*b* have the enabled level, and the first multiplexing signals Sm1_*a*-Sm1_*b* the third multiplexing signals Sm3_*a*-Sm3_*b* have the disabled level. The second multiplexing switches M2_*a*-M2_*b* are conducted, and the first multiplexing switches M1_*a*-M1_*b* and the third multiplexing switches M3_*a*-M3_*b* are switched-off. The first multiplexer 230 outputs the first control signal Cs1 and the second control signal Cs2 as the first gate signal Fg_2 and the second gate signal Sg_2, respectively, to the output circuit 220_2. In addition, the fifth multiplexing signals Sm5_*a*-Sm5_*b* have the disabled level, and the fourth multiplexing signals Sm4_*a*-Sm4_*b* and the sixth multiplexing signals Sm6_*a*-Sm6_*b* have the enabled level. The fifth multiplexing switches M5_*a*-M5_*b* are switched off, and the fourth multiplexing switches M4_*a*-M4_*b* and the sixth multiplexing switches M6_*a*-M6_*b* are conducted. The second multiplexer 240 outputs the reference voltage Vdd and the reference voltage VddAH as the first gate signals Fg_1 and Fg_3 and the second gate signals Sg_1 and Sg_3 to the output circuits 220_1 and 220_3.

Therefore, the output circuit 220_2 is enabled to provide the positive-polarity output signal Vop_2 to the data line DL_2, and the output circuits 220_1 and 220_3 are disabled (the data line DL_1 may receive a negative-polarity output signal Von_2 from the output buffer 118_2, which will be discussed in the following by reference to FIG. 7). The second demultiplexing signal Dm2 has the enabled level to conduct the second demultiplexing switch 254, so as to output the output signal Vop_2 as the feedback signal Fb. The first demultiplexing signal Dm1 and the third demultiplexing signal Dm3 have the disabled level to switch off the first demultiplexing switch 252 and the third demultiplexing switch 256.

As can be appreciated from the above, the first demultiplexing switch 252, the second demultiplexing switch 254 and the third demultiplexing switch 256 cooperate with the first multiplexing switches M1_*a*-M1_*b*, the second multiplexing switches M2_*a*-M2_*b* and the third multiplexing switches M3_*a*-M3_*b* in the same phase. On the other hand, the first demultiplexing switch 252, the second demultiplexing switch 254 and the third demultiplexing switch 256 cooperate with the fourth multiplexing switches M4_*a*-M4_*b*, the fifth multiplexing switches M5_*a*-M5_*b* and the sixth multiplexing switches M6_*a*-M6_*b* in the opposite phase.

As can be appreciated from the above, the first multiplexer 230 is for setting the polarity of the data lines DL_1-DL_2, and for setting the high-impedance state of the data lines DL_1-DL_2. The output loading of the output circuits 220_1-220_2 is significantly reduced by arranging the first multiplexer 230 as a previous-stage circuit of the output circuits 220_1-220_2. Therefore, the output buffer 118_1 has a high driving capability to the data lines DL_1-DL_2, which makes the output buffer 118_1 suitable for high resolution and/or high frame rate applications.

The other positive-polarity output buffers (e.g., the output buffers 118_3, 118_5, etc.) have components, connection relationships and operations similar to those discussed above with respect to the output buffer 118_1 of FIG. 2, and the differences are discussed in the following. In the first output stage St_1, the positive-polarity output buffers (e.g., the output buffers 118_1, 118_3, 118_5, etc.) are each configured to drive a corresponding one of the data lines DL_1-DL_m having the odd index. In the first output stage St_1, for example, the output buffers 118_1, 118_3 and 118_5 may provide their positive-polarity output signals Vop_1 respectively to the data lines DL_1, DL_3 and DL_5, and so forth. In addition to that, in the second output stage St_2, the positive-polarity output buffers (e.g., the output buffers 118_1, 118_3, 118_5, etc.) are each configured to drive a corresponding one of the data lines DL_1-DL_m having the even index. In the second output stage St_2, for example, the output buffers 118_1, 118_3 and 118_5 may provide their positive-polarity output signals Vop_2 respectively to the data lines DL_2, DL_4 and DL_6, and so forth.

Figure 6:
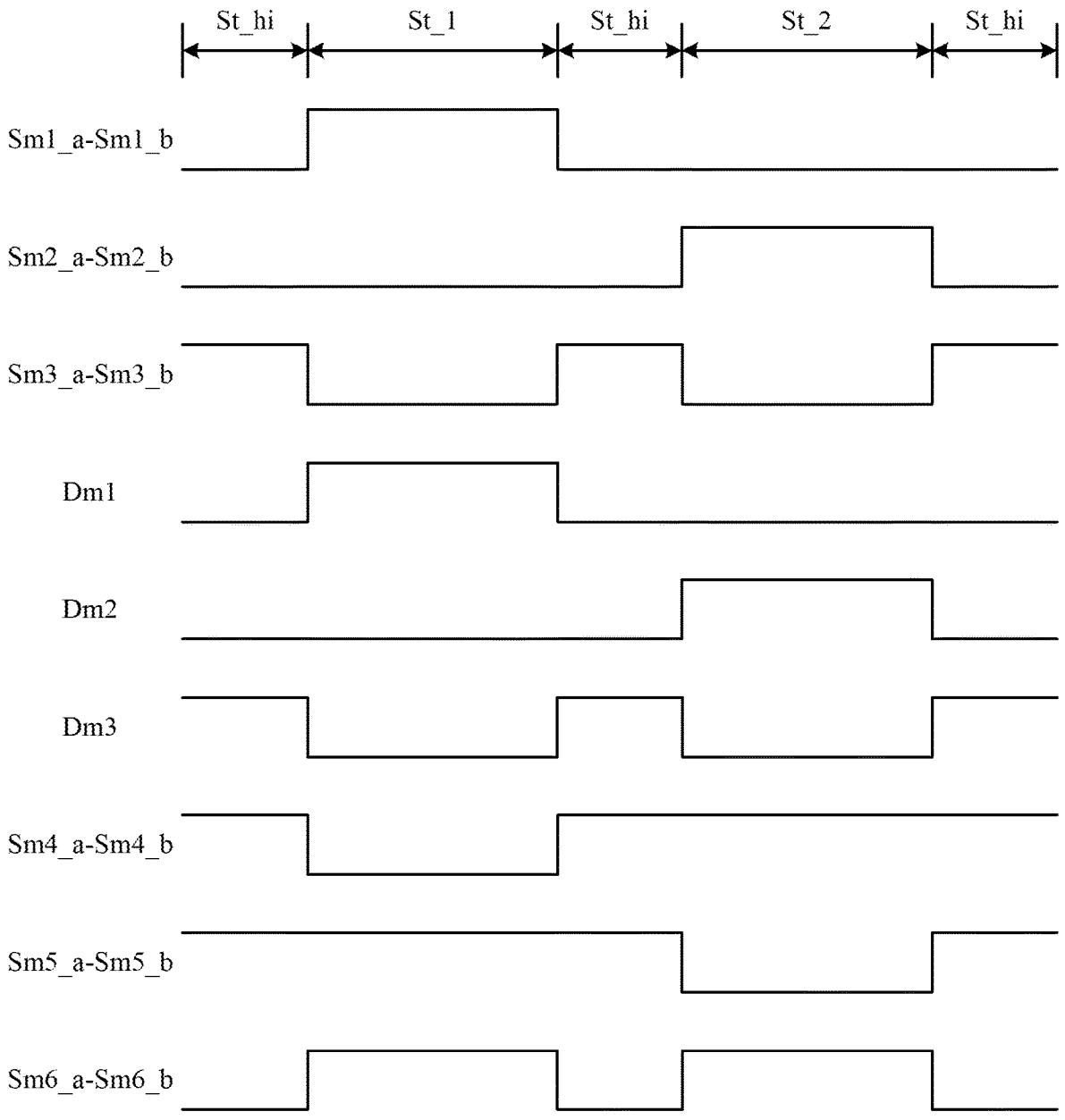
FIG. 6 is a waveform schematic of the output buffer of FIG. 2 according to an embodiment of the present disclosure.
Figure 7:
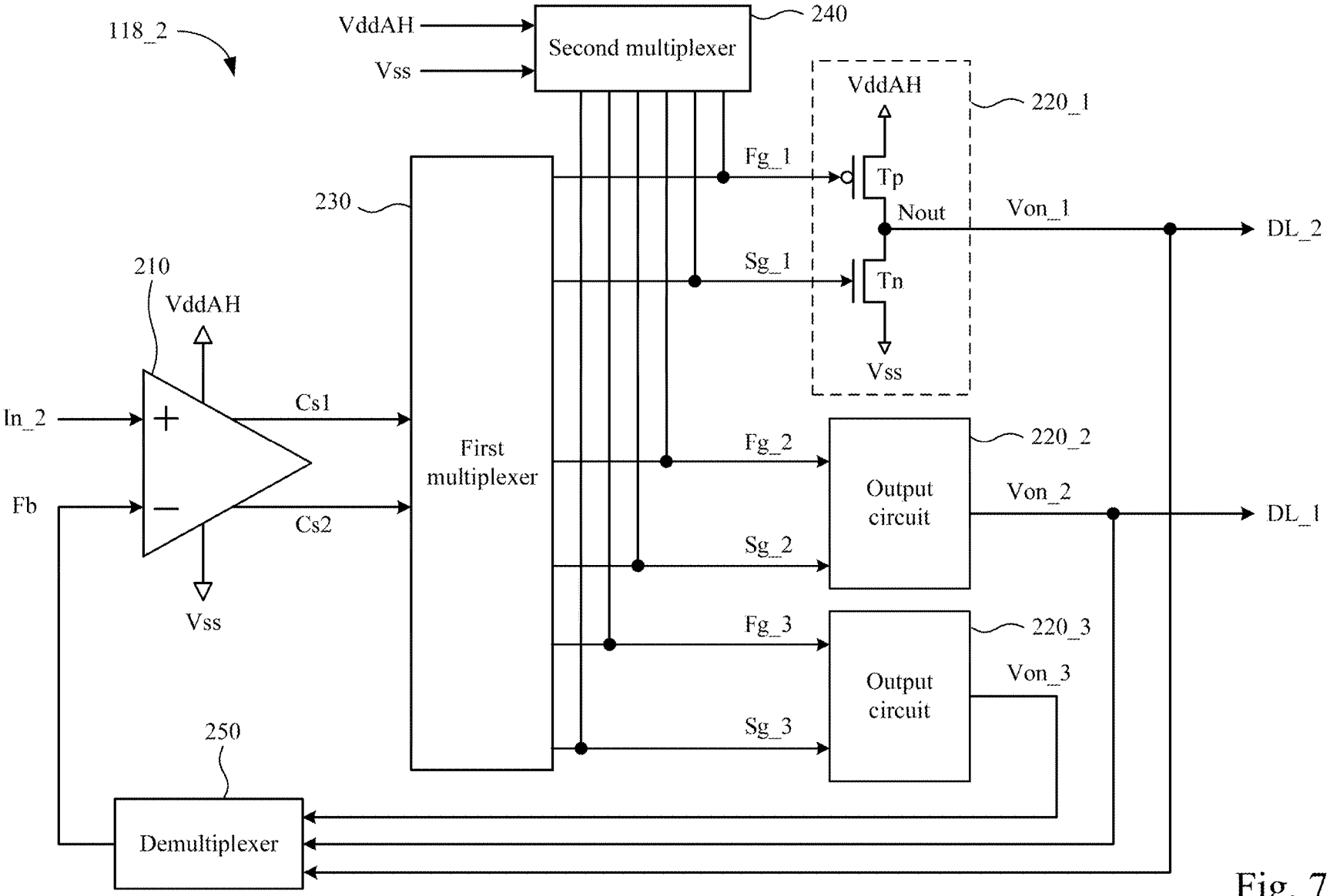
FIG. 7 is a schematic diagram of a negative-polarity output buffer according to an embodiment of the present disclosure.

FIG. 7 is a schematic diagram of the output buffer 118_2 according to an embodiment of the present disclosure. The output buffer 118_2 has components, connection relationships and operations similar to those discussed above with respect to the output buffer 118_1 of FIG. 2, and therefore only the differences are discussed in the following. In the output buffer 118_2, the output circuit 220_1 is coupled with the data line DL_2, and the output circuit 220_2 is coupled with the data line DL_1. Since the signal waveforms illustrated by reference to FIG. 6 are also applicable to the output buffer 118_2, the output buffer 118_2 is configured to provide the negative-polarity output signal Von_1 to the data line DL_2 in the first output stage St_1 and to provide the negative-polarity output signal Von_2 to the data line DL_1 in the second output stage St_2.

In some embodiments, the input circuit 210 of the output buffer 118_2 may receive the reference voltage VddAH and a reference voltage Vss as the operating voltages used to amplify the input signal In_2. The reference voltage Vss is lower than the reference voltage VddAH. The second multiplexer 240 of the output buffer 118_2 may output the reference voltage VddAH and the reference voltage Vss as the first gate signals Fg_1-Fg_3 and the second gate signals Sg_1-Sg_3, respectively.

The other negative-polarity output buffers (e.g., the output buffers 118_4, 118_6, etc.) have components, connection relationships and operations similar to those discussed above with respect to the output buffer 118_2 of FIG. 7, and the differences are discussed in the following. In the first output stage St_1, the negative-polarity output buffers (e.g., the output buffers 118_2, 118_4, 118_6, etc.) are each configured to drive a corresponding one of the data lines DL_1-DL_m having the even index. In the first output stage St_1, for example, the output buffers 118_2, 118_4 and 118_6 may provide their negative-polarity output signals Von_1 respectively to the data lines DL_2, DL_4 and DL_6, and so forth. In addition to that, in the second output stage St_2, the negative-polarity output buffers (e.g., the output buffers 118_2, 118_4, 118_6, etc.) are each configured to drive a corresponding one of the data lines DL_1-DL_m having the odd index. In the second output stage St_2, for example, the output buffers 118_2, 118_4 and 118_6 may provide their negative-polarity output signals Von_2 respectively to the data lines DL_1, DL_3 and DL_5, and so forth.

In some embodiments, the output buffers 118_1-**118_*m* of FIG. 1 enter the high-impedance stage St_hi simultaneously, resulting that the data lines DL_1-DL_m are free from receiving signals from the output buffers 118_1-118_*m*** in the high-impedance stage St_hi.

Figure 8:
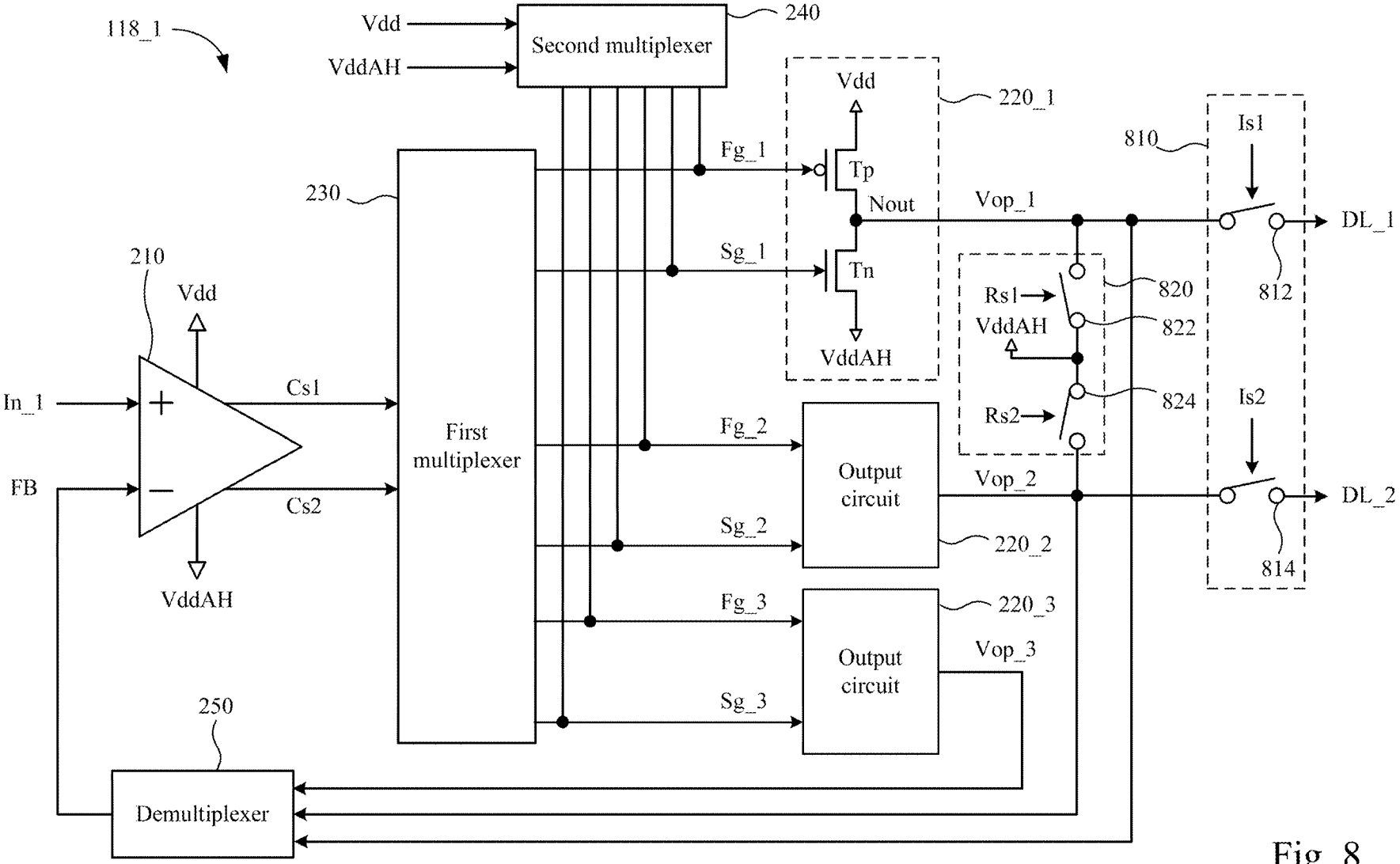
FIG. 8 is a schematic diagram of a positive-polarity output buffer according to an embodiment of the present disclosure.

FIG. 8 is a schematic diagram of the output buffer 118_1 according to an embodiment of the present disclosure. The embodiment of FIG. 8 is similar to the embodiment of FIG. 2, and therefore the following paragraphs are focused on discussing the differences. In the embodiment of FIG. 8, the output buffer 118_1 further includes an isolation circuit 810 and a reset circuit 820 configured to protect internal components of the output buffer 118_1 against electrical overstress. The isolation circuit 810 includes a first isolation switch 812 and a second isolation switch 814. The first isolation switch 812 is coupled between the output node Nout of the output circuit 220_1 and the data line DL_1, and is controlled by a first isolation signal Is1 to transmit the output signal Vop_1 to the data line DL_1. The second isolation switch 814 is coupled between the output node Nout of the output circuit 220_2 and the data line DL_2, and is controlled by a second isolation signal Is2 to transmit the second output signal Vop_2 to the data line DL_2.

The reset circuit 820 includes a first reset switch 822 and a second reset switch 824. The first reset switch 822 is coupled with the output node Nout of the output circuit 220_1, and is controlled by a first reset signal Rs1 to transmit the reference voltage VddAH to the output node Nout of the output circuit 220_1. The second reset switch 824 is coupled with the output node Nout of the output circuit 220_2, and is controlled by a second reset signal Rs2 to transmit the reference voltage VddAH to the output node Nout of the output circuit 220_2.

The reset circuit 820 provides the lower one (e.g., the reference voltage VddAH) of the operating voltages of the input circuit 210 to the output nodes Nout of the output circuits 220_1-220_2.

Figure 9:
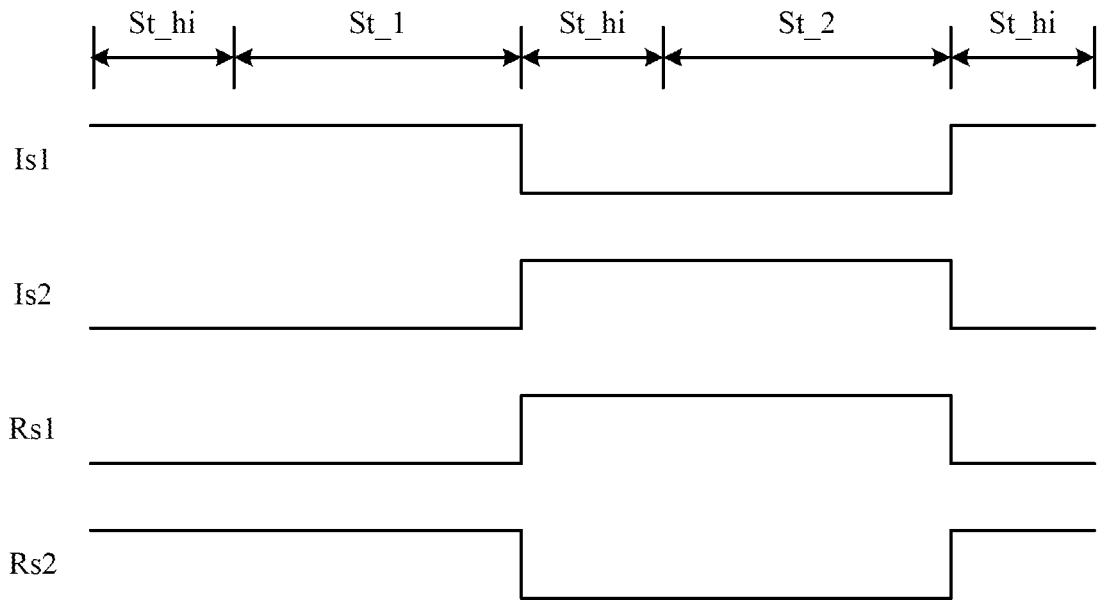
FIG. 9 is a waveform schematic of an isolation circuit and a reset circuit according to an embodiment of the present disclosure.

Reference is made to FIG. 6, FIG. 8 and FIG. 9, in which FIG. 9 is a waveform schematic of the isolation circuit 810 and the reset circuit 820 according to an embodiment of the present disclosure. In operation, the first isolation switch 812 and the second isolation switch 814 are configured to conduct alternately; the first reset switch 822 is configured to conduct alternately with the first isolation switch 812; and the second reset switch 824 is configured to conduct alternately with the second isolation switch 814.

Specifically, with respect to the first output stage St_1 and the high-impedance stages St_hi before the first output stage St_1, the first isolation signal Is1 and the second reset signal Rs2 have the enabled level to conduct the first isolation switch 812 and the second reset switch 824. The second isolation signal Is2 and the first reset signal Rs1 have the disabled level to switch off the second isolation switch 814 and the first reset switch 822. Therefore, the positive-polarity output signal Vop_1 is transmitted from the output circuit 220_1 to the data line DL_1 through the first isolation switch 812. The output node Nout of the output circuit 220_2 is set to the reference voltage VddAH. The data line DL_2 may receive the negative-polarity output signal Vop_1 provided by the output buffer 118_2.

With respect to the second output stage St_2 and the high-impedance stage St_hi before the second output stage St_2, the second isolation signal Is2 and the first reset signal Rs1 have the enabled level to conduct the second isolation switch 814 and the first reset switch 822. The first isolation signal Is1 and the second reset signal Rs2 have the disabled level to switch off the first isolation switch 812 and the second reset switch 824. Therefore, the positive-polarity output signal Vop_2 is transmitted from the output circuit 220_2 to the data line DL_2 through the second isolation switch 814. The output node Nout of the output circuit 220_1 is set to the reference voltage VddAH, and the data line DL_1 may receive the negative-polarity output signal Von_2 provided by the output buffer 118_2.

In the embodiment of FIG. 8, the other positive output buffers (e.g., the output buffers 118_3, 118_5, etc.) may each have components, connection relationships and operations similar to those discussed above with respect to the output buffer 118_1 of FIG. 8 and are configured to drive different data lines as aforementioned, and therefore those descriptions are omitted here.

Figure 10:
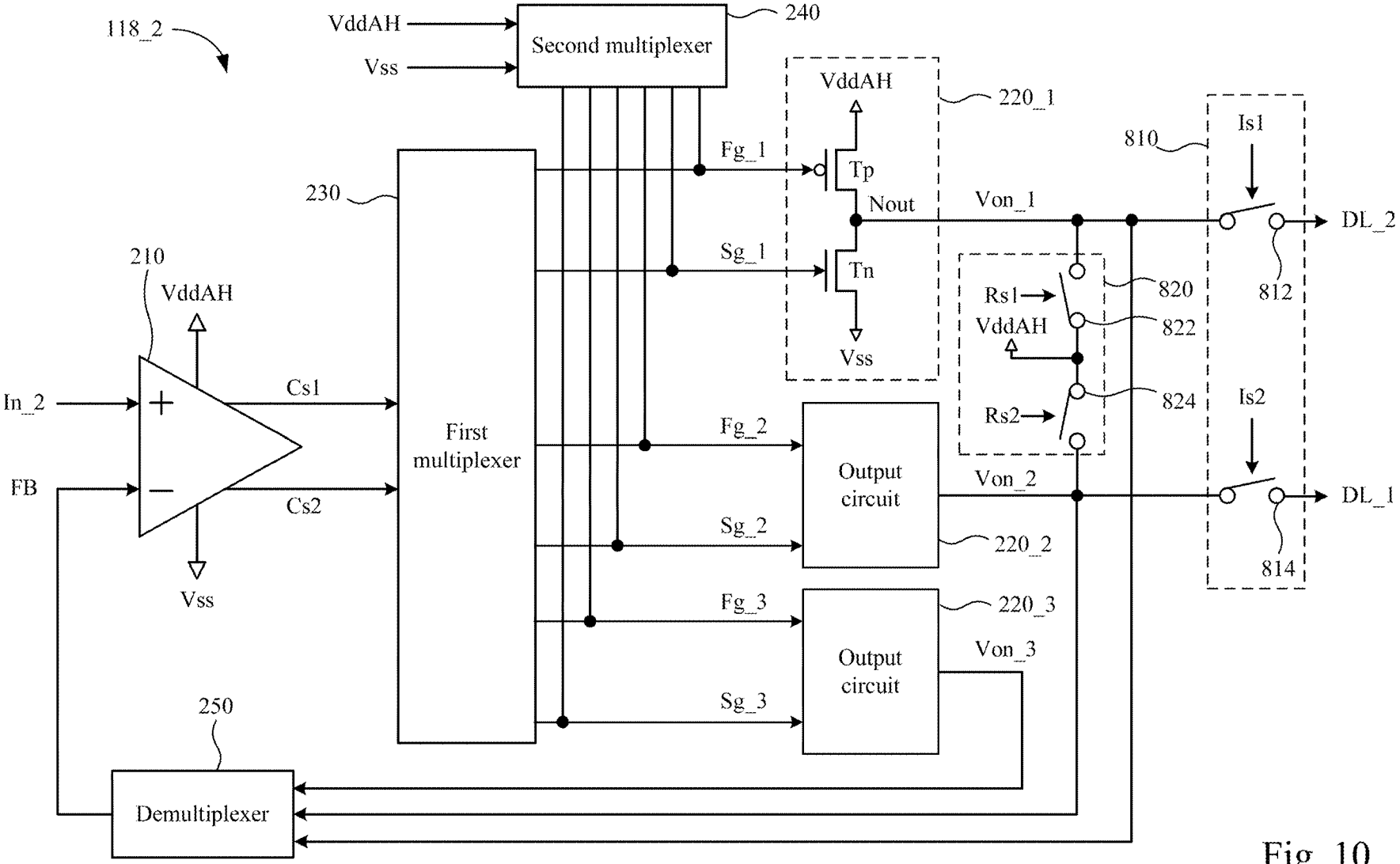
FIG. 10 is a schematic diagram of a negative-polarity output buffer according to an embodiment of the present disclosure.

FIG. 10 is a schematic diagram of the output buffer 118_2 according to an embodiment of the present disclosure. The embodiment of FIG. 10 is similar to the embodiment of FIG. 7, and therefore the following paragraphs are focused on discussing the differences. In the embodiment of FIG. 10, the output buffer 118_2 further includes the above discussed isolation circuit 810 and the reset circuit 820. The signal waveforms discussed by reference to FIG. 9 are also applicable to the output buffer 118_2 of FIG. 10. In this embodiment, the first isolation switch 812 is coupled between the output node Nout of the output circuit 220_1 and the data line DL_2, and the second isolation switch 814 is coupled between the output node Nout of the output circuit 220_2 and the data line DL_1.

In the output buffer 118_2, the reset circuit 820 is configured to provide the higher one of the operating voltages of the input circuit 210 to the output nodes Nout of the output circuits 220_1-220_2. As mentioned above, the operating voltages of the negative-polarity output buffer (e.g., the output buffer 118_2) may be the reference voltage VddAH and the reference voltage Vss lower than the reference voltage VddAH. Therefore, the reset circuit 820 of the output buffer 118_2 may provide the reference voltage VddAH to the output nodes Nout of the output circuits 220_1-220_2.

In the embodiment of FIG. 10, the other negative output buffers (e.g., the output buffers 118_4, 118_6, etc.) may each have components, connection relationships and operations similar to those discussed above with respect to the output buffer 118_2 of FIG. 10 and are configured to drive different data lines as aforementioned, and therefore those descriptions are omitted here.

In some embodiments, the reference voltages Vdd, VddAH and Vss are 12 V, 6 V and 0 V, respectively. Therefore, the positive-polarity output signals Vop_1 and Vop_2 have a voltage range of 6-12 V, and the negative-polarity output signals Von_1 and Von_2 have a voltage range of 0-6 V. With respect to the positive output buffer 118_1 of FIG. 8, by setting the output node Nout of the output circuit 220_2 to the reference voltage VddAH (i.e., 6 V) in the first output stage St_1, it is ensured that a voltage difference across the second isolation switch 814 is not higher than 6 V, and it is also ensured that voltage differences across the pull-up transistor Tp and the pull-down transistor Tn of the output circuit 220_2 are not higher than 6 V. In addition to that, by setting the output node Nout of the output circuit 220_1 of FIG. 8 to the reference voltage VddAH (i.e., 6 V) in the second output stage St_2, it is ensured that a voltage difference across the first isolation switch 812 is not higher than 6 V, and it is also ensured that voltage differences across the pull-up transistor Tp and the pull-down transistor Tn of the output circuit 220_1 are not higher than 6 V. It is worth mentioning that said voltage difference may be up to 12 V without the isolation circuit 810 and the reset circuit 820. The advantages of reducing voltage differences discussed above with respect to the positive output buffer 118_1 are also applicable to the negative output buffer 118_2. For the sake of brevity, those descriptions are omitted here.

In some embodiments, the switches of the first multiplexer 230, the switches of the demultiplexer 250 and/or the switches of the isolating circuit 810 may be realized by transition switches. The transition switches each include a P-type transistor and an N-type transistor coupled in a parallel connection. In this case, the disable level in FIG. 6 and FIG. 9 represents that a high voltage is applied to a gate of the P-type transistor and a low voltage is applied to a gate of the N-type transistor. The enable level in FIG. 6 and FIG. 9 represents that the low voltage is applied to the gate of the P-type transistor and the high voltage is applied to the gate of the N-type transistor.

In an embodiment that the isolation circuit 810 is realized by the transition switches, the first isolation switch 812 and the second isolation switch 814 of the positive-polarity output buffer (e.g., the output buffer 118_1) include the P-type transistors receiving by the gate terminals thereof the lower one of the operating voltages (e.g., the reference voltage VddAH) of the input circuit 210, and include the N-type transistors receiving the first isolation signal Is1 and the second isolation signal Is2 by the gate terminals thereof. In addition, the first isolation switch 812 and the second isolation switch 814 of the negative-polarity output buffer (e.g., the output buffer 118_2) include the N-type transistors receiving by the gate terminals thereof the higher one of the operating voltages (e.g., the reference voltage VddAH) of the input circuit 210, and include the P-type transistors receiving the first isolation signal Is1 and the second isolation signal Is2 by the gate terminals thereof.

In some embodiments, in the positive-polarity output buffer (e.g., the output buffer 118_1), the voltage received by the gate terminals of the P-type transistors of the isolation circuit 810 and the voltage provided by the reset circuit 820 to the output nodes Nout are both the reference voltage VddAH. In the negative-polarity output buffer (e.g., the output buffer 118_2), the voltage received by the gate terminals of the N-type transistors of the isolation circuit 810 and the voltage provided by the reset circuit 820 to the output nodes Nout also both are the reference voltage VddAH. By this arrangement, the number of the control signals is reduced to decrease the circuit layout area.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Other embodiments of the present disclosure will be apparent to those skilled in the art from consideration of the specification and practice of the present disclosure disclosed herein. It is intended that the specification and examples be considered as exemplary only, with a true scope and spirit of the present disclosure being indicated by the following claims.

What is claimed is:

1. A source driver, configured to receive display data, and comprising a plurality of output buffers, wherein each output buffer comprises:

an input circuit, configured to generate a first control signal and a second control signal according to a feedback signal and an input signal corresponding to the display data;

a plurality of output circuits, wherein each output circuit is controlled by a first gate signal and a second gate signal to provide a corresponding one of a plurality of output signals;

a first multiplexer, configured to provide the first control signal and the second control signal to one of the plurality of output circuits as the first gate signal and the second gate signal, respectively;

a second multiplexer, configured to provide a first reference voltage and a second reference voltage as the first gate signal and the second gate signal, respectively, to other of the plurality of output circuits; and a demultiplexer, configured to provide one of the plurality of output signals as the feedback signal.

2. The source driver of claim 1, wherein a first output signal of the plurality of output signals generated by a first output circuit of the plurality of output circuits is configured to be provided to a first data line of a plurality of data lines, a second output signal of the plurality of output signals generated by a second output circuit of the plurality of output circuits is configured to be provided to a second data line of the plurality of data lines, and a third output signal of the plurality of output signals generated by a third output circuit of the plurality of output circuits is free from being provided to the plurality of data lines.

3. The source driver of claim 2, wherein the output buffer further comprises an isolation circuit, the isolation circuit comprises:

a first isolation switch, configured to transmit the first output signal from an output node of the first output circuit to the first data line according to a first isolation signal; and a second isolation switch, configured to transmit the second output signal from an output node of the second output circuit to the second data line according to a second isolation signal, wherein the first isolation switch and the second isolation switch are configured to conduct alternately.

4. The source driver of claim 3, wherein the output buffer further comprises a reset circuit, the reset circuit comprises:

a first reset switch, configured to conduct alternately with the first isolation switch, and configured to transmit one of operating voltages of the input circuit to the output node of the first output circuit; and a second reset switch, configured to conduct alternately with the second isolation switch, and configured to transmit the one of the operating voltages of the input circuit to the output node of the second output circuit, wherein the input circuit is configured to use the operating voltages to amplify the input signal.

5. The source driver of claim 4, wherein each of the first isolation switch and the second isolation switch is a transition switch comprising:

a P-type transistor; and an N-type transistor, wherein if the plurality of output signals are positive-polarity, a gate terminal of the P-type transistor is configured to receive the one of the operating voltages, and a gate terminal of the N-type transistor is configured to receive the first isolation signal or the second isolation signal, wherein if the plurality of output signals are negative-polarity, the gate terminal of the N-type transistor is configured to receive the one of the operating voltages, and the gate terminal of the P-type transistor is configured to receive the first isolation signal or the second isolation signal.

6. The source driver of claim 2, wherein the first multiplexer comprises a pair of first multiplexing switches, a pair of second multiplexing switches and a pair of third multiplexing switches, wherein the pair of first multiplexing switches are configured to operate synchronously to transmit the first control signal and the second control signal, respectively, to the first output circuit, wherein the pair of second multiplexing switches are configured to operate synchronously to transmit the first control signal and the second control signal, respectively, to the second output circuit, wherein the pair of third multiplexing switches are configured to operate synchronously to transmit the first control signal and the second control signal, respectively, to the third output circuit.

7. The source driver of claim 2, wherein the second multiplexer comprises a pair of fourth multiplexing switches, a pair of fifth multiplexing switches and a pair of sixth multiplexing switches, wherein the pair of fourth multiplexing switches are configured to conduct synchronously to transmit the first reference voltage and the second reference voltage, respectively, to the first output circuit, wherein the pair of fifth multiplexing switches are configured to conduct synchronously to transmit the first reference voltage and the second reference voltage, respectively, to the second output circuit, wherein the pair of sixth multiplexing switches are configured to conduct synchronously to transmit the first reference voltage and the second reference voltage, respectively, to the third output circuit.

8. The source driver of claim 2, wherein the demultiplexer comprises:

a first demultiplexing switch, comprising a first terminal configured to receive the first output signal;

a second demultiplexing switch, comprising a second terminal configured to receive the second output signal; and a third demultiplexing switch, comprising a first terminal configured to receive the third output signal, wherein a second terminal of the first demultiplexing switch, a second terminal of the second demultiplexing switch and a second terminal of the third demultiplexing switch are coupled together and configured to provide one of the first output signal, the second output signal and the third output signal as the feedback signal.

9. The source driver of claim 2, wherein each output circuit comprises:

a pull-up transistor, comprising a gate terminal configured to receive the first gate signal; and a pull-down transistor, comprising a gate terminal configured to receive the second gate signal, wherein the pull-up transistor and the pull-down transistor are coupled in series, and an output node between the pull-up transistor and the pull-down transistor are configured to provide the corresponding one of the plurality of output signals.

10. The source driver of claim 1, wherein the input circuit is configured to receive the first reference voltage and the second reference voltage as operating voltages used to amplify the input signal.

11. An output buffer, comprising:

an input circuit, configured to generate a first control signal and a second control signal according to a feedback signal and an input signal;

a plurality of output circuits, wherein each output circuit is controlled by a first gate signal and a second gate signal to provide a corresponding one of a plurality of output signals;

a first multiplexer, configured to provide the first control signal and the second control signal to one of the plurality of output circuits as the first gate signal and the second gate signal, respectively;

a second multiplexer, configured to provide a first reference voltage and a second reference voltage as the first gate signal and the second gate signal, respectively, to other of the plurality of output circuits; and a demultiplexer, configured to provide one of the plurality of output signals as the feedback signal.

12. The output buffer of claim 11, wherein a first output signal of the plurality of output signals generated by a first output circuit of the plurality of output circuits is configured to be provided to a first data line of a plurality of data lines, a second output signal of the plurality of output signals generated by a second output circuit of the plurality of output circuits is configured to be provided to a second data line of the plurality of data lines, and a third output signal of the plurality of output signals generated by a third output circuit of the plurality of output circuits is free from being provided to the plurality of data lines.

13. The output buffer of claim 12, further comprising an isolation circuit, wherein the isolation circuit comprises:

a first isolation switch, configured to transmit the first output signal from an output node of the first output circuit to the first data line according to a first isolation signal; and a second isolation switch, configured to transmit the second output signal from an output node of the second output circuit to the second data line according to a second isolation signal, wherein the first isolation switch and the second isolation switch are configured to conduct alternately.

14. The output buffer of claim 13, further comprising a reset circuit, wherein the reset circuit comprises:

a first reset switch, configured to conduct alternately with the first isolation switch, and configured to transmit one of operating voltages of the input circuit to the output node of the first output circuit; and a second reset switch, configured to conduct alternately with the second isolation switch, and configured to transmit the one of the operating voltages of the input circuit to the output node of the second output circuit, wherein the input circuit is configured to use the operating voltages to amplify the input signal.

15. The output buffer of claim 14, wherein each of the first isolation switch and the second isolation switch is a transition switch comprising:

a P-type transistor; and an N-type transistor, wherein if the plurality of output signals are positive-polarity, a gate terminal of the P-type transistor is configured to receive the one of the operating voltages, and a gate terminal of the N-type transistor is configured to receive the first isolation signal or the second isolation signal, wherein if the plurality of output signals are negative-polarity, the gate terminal of the N-type transistor is configured to receive the one of the operating voltages, and the gate terminal of the P-type transistor is configured to receive the first isolation signal or the second isolation signal.

16. The output buffer of claim 12, wherein the first multiplexer comprises a pair of first multiplexing switches, a pair of second multiplexing switches and a pair of third multiplexing switches, wherein the pair of first multiplexing switches are configured to operate synchronously to transmit the first control signal and the second control signal, respectively, to the first output circuit, wherein the pair of second multiplexing switches are configured to operate synchronously to transmit the first control signal and the second control signal, respectively, to the second output circuit, wherein the pair of third multiplexing switches are configured to operate synchronously to transmit the first control signal and the second control signal, respectively, to the third output circuit.

17. The output buffer of claim 12, wherein the second multiplexer comprises a pair of fourth multiplexing switches, a pair of fifth multiplexing switches and a pair of sixth multiplexing switches, wherein the pair of fourth multiplexing switches are configured to conduct synchronously to transmit the first reference voltage and the second reference voltage, respectively, to the first output circuit, wherein the pair of fifth multiplexing switches are configured to conduct synchronously to transmit the first reference voltage and the second reference voltage, respectively, to the second output circuit, wherein the pair of sixth multiplexing switches are configured to conduct synchronously to transmit the first reference voltage and the second reference voltage, respectively, to the third output circuit.

18. The output buffer of claim 12, wherein the demultiplexer comprises:

a first demultiplexing switch, comprising a first terminal configured to receive the first output signal;

a second demultiplexing switch, comprising a second terminal configured to receive the second output signal; and a third demultiplexing switch, comprising a first terminal configured to receive the third output signal, wherein a second terminal of the first demultiplexing switch, a second terminal of the second demultiplexing switch and a second terminal of the third demultiplexing switch are coupled together and configured to provide one of the first output signal, the second output signal and the third output signal as the feedback signal.

19. The output buffer of claim 12, wherein each output circuit comprises:

a pull-up transistor, comprising a gate terminal configured to receive the first gate signal; and a pull-down transistor, comprising a gate terminal configured to receive the second gate signal, wherein the pull-up transistor and the pull-down transistor are coupled in series, and an output node between the pull-up transistor and the pull-down transistor are configured to provide the corresponding one of the plurality of output signals.

20. The output buffer of claim 11, wherein the input circuit is configured to receive the first reference voltage and the second reference voltage as operating voltages used to amplify the input signal.

* * * * *